US006338377B1

(12) United States Patent
Domel

(10) Patent No.: US 6,338,377 B1
(45) Date of Patent: Jan. 15, 2002

(54) SKYLIGHT ASSEMBLY WITH HEAD RAIL-MOUNTED ACTUATOR

(75) Inventor: Douglas R. Domel, Santa Clarita, CA (US)

(73) Assignee: Harmonic Design, Incorporated, Valencia, CA (US)

( * ) Notice: Subject to any disclaimer, the term of this patent is extended or adjusted under 35 U.S.C. 154(b) by 0 days.

(21) Appl. No.: 09/586,819

(22) Filed: Jun. 5, 2000

(51) Int. Cl.[7] ..... A47H 5/00

(52) U.S. Cl. ..... 160/84.02; 160/84.06; 160/170 R

(58) Field of Search ..... 160/84.04, 84.05, 160/84.06, 170 R, 171 R, 84.02

(56) References Cited

U.S. PATENT DOCUMENTS 4,593,737 A * 6/1986 Clemente
4,762,159 A * 8/1988 Ford
4,807,686 A 2/1989 Schnebly et al. ..... 160/84.1
4,951,730 A 8/1990 Hsu ..... 160/310
5,184,660 A * 2/1993 Jelic
5,495,153 A * 2/1996 Domel et al.
5,725,040 A * 3/1998 Domel
6,119,755 A * 9/2000 Oskam

* cited by examiner

*Primary Examiner*—Blair M. Johnson
(74) *Attorney, Agent, or Firm*—John L. Rogitz

(57) ABSTRACT

A skylight assembly with head rail-mounted actuator includes a head rail having a shaft rotatably disposed therein. A battery-powered actuator is also disposed within the head rail and coupled to the shaft. The actuator is remotely operable to cause the shaft to rotate. As the shaft rotates, a collapsible shade connected to the shaft moves between an open configuration, wherein the shade is collapsed to allow sunlight to propagated through the skylight, and a closed configuration, wherein the shade is extended to cover the skylight.

12 Claims, 3 Drawing Sheets

SKYLIGHT ASSEMBLY WITH HEAD RAIL-MOUNTED ACTUATOR

TECHNICAL FIELD

The present invention relates generally to coverings for motorized skylights and other non-vertical openings.

BACKGROUND OF THE INVENTION

Skylights are windows that are installed in the roof or ceiling of a building, e.g., a home. Skylights are often used to enhance the ambiance of rooms within business buildings and dwellings by providing a direct source of natural light and a view of the sky. In addition to aesthetic enhancements, skylights also minimize the cost of lighting buildings during the day by providing alternate sources of light. On particularly sunny days, skylights also serve as alternative heat sources for the buildings in which they are installed.

In order to regulate the amount of light propagating into a room having skylights, the skylights are often equipped with shades that can be opened or closed in order to maximize or minimize the amount of sunlight passing into the building through the skylights. Thus, the shades can be opened during the day to permit sunlight to enter the room, or closed during particularly warm days to prevent overheating of the room and fading of material within the room. Likewise, the shades can be closed at night to prevent heat within the roni from dissipating through the window into the cool evening air.

Manual shades have been provided for skylights, but since skylights are typically elevated beyond the reach of a person without the aid of a ladder or an elongated handle, the present invention recognizes that it is advantageous to provide for remote or automatic positioning of the shades. For example, it would be advantageous to provide for the automatic nighttime closing of skylight shades in a business building for security reasons and energy conservation, rather than to rely on personnel to remember to manually close all skylight shades before vacating the premises for the evening. Also, remote operation of the skylight shades would enable persons to regulate the amount of light entering their rooms, without requiring the persons to climb a ladder or manipulate an awkward handle.

In light of the above problems, the present invention recognizes a need for a comparatively simple device for remotely or automatically opening and closing skylight shades.

SUMMARY OF THE INVENTION

A skylight assembly with actuator includes a head rail and a shaft rotatably disposed within the head rail. A collapsible shade is engaged with the shaft and is movable between an open configuration, wherein the shade is fully collapsed, and a closed configuration, wherein the shade is extended. The skylight assembly also includes at least one electric motor in the head rail that is coupled to the shaft and at least one dc battery that is supported by the head rail and is electrically connected to the motor.

In a preferred embodiment, the skylight assembly includes at least one extender cord that is attached to the shade and partially wound around the shaft. The extender cord causes the shade to move to the closed configuration as the shaft rotates in a first direction. Preferably, the skylight assembly also includes at least one retractor cord that is attached to the shade and partially wound around the shaft. The retractor cord causes the shade to move to the open configuration as the shaft rotates in a second direction.

Preferably, the collapsible shade is an accordion-type shade. Furthermore, the skylight assembly includes at least one static cord that is looped through the shade to provide at least two semi-rigid guides along which the shade slides between the open configuration and closed configuration. The skylight assembly also includes at least one tensioning device to keep the static cord taut. Preferably, the tensioning device is a spring attached to at least one end of the static cord. In a preferred embodiment, the battery is the sole source of power for the motor and the battery is mounted in the head rail.

In another aspect of the present invention, a device for moving a collapsible shade in a skylight assembly includes an actuator that has at least one electric motor in a head rail of the skylight assembly. In this aspect, the electric motor is coupled to a shaft in the head rail and rotates the shaft to move the shade between an open configuration, wherein the shade is collapsed, and a closed configuration, wherein the shade is extended. This aspect of the present invention also includes at least one direct current alkaline or lithium battery.

In another aspect of the present invention, a powered skylight covering assembly includes a head rail and a shaft rotatably disposed therein. A collapsible shade is coupled to the shaft, such that as the shaft rotates, the shade moves between an open configuration, wherein the shade is collapsed, and a closed configuration, wherein the shade is extended. This aspect of the present invention also includes an electric motor that is disposed in the head rail and a coupling operably engaged with the motor to engage the motor with the shaft for rotating the shaft. Also included is at least one primary dc battery that is the sole source of energy associated with the skylight covering. The battery is supported by the head rail.

The present invention will now be described, by way of example, with reference to the accompanying drawings, in which:

DESCRIPTION OF AN EMBODIMENT OF THE INVENTION

Figure 1:
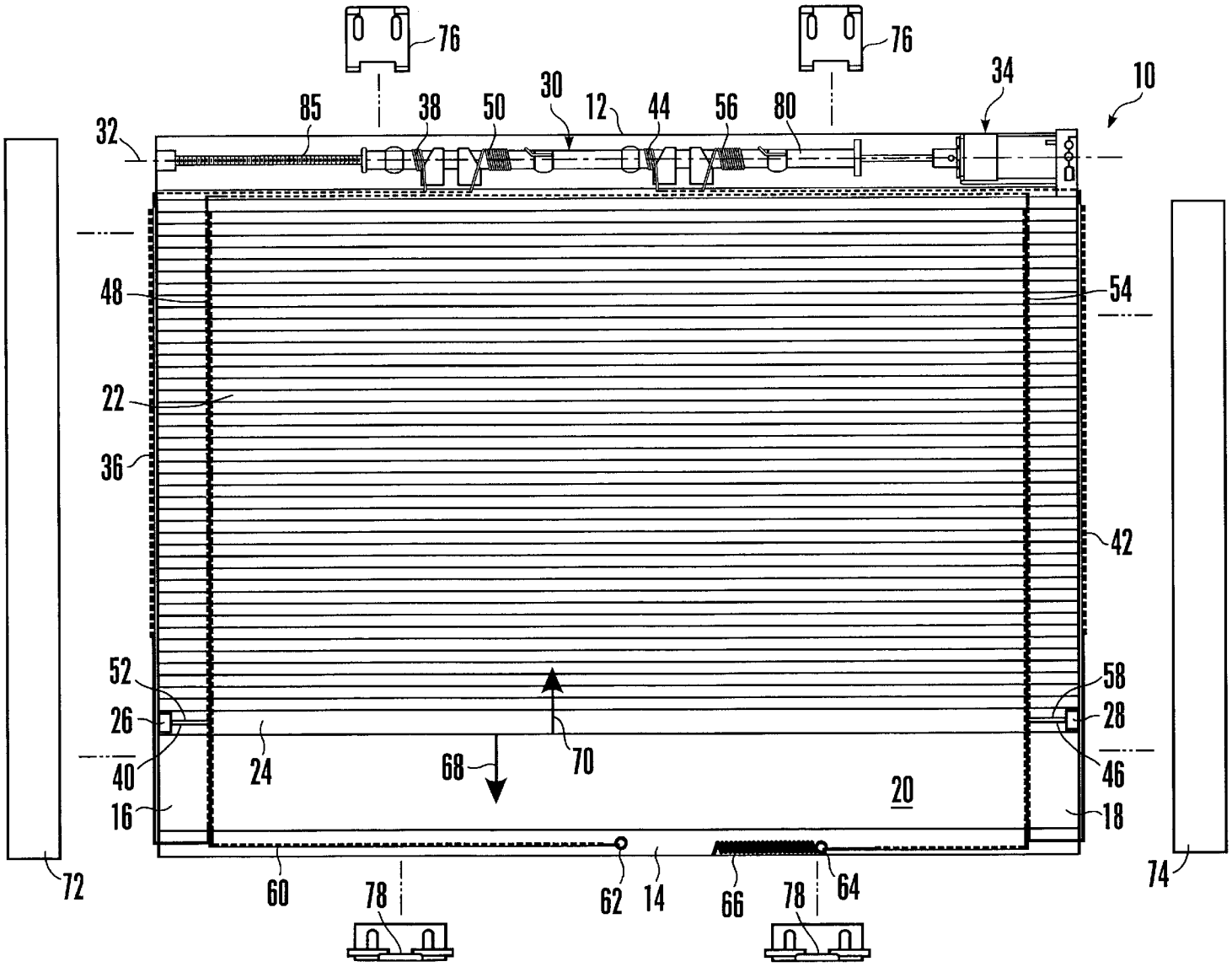
FIG. 1 is an exploded plan view of the skylight assembly with head rail mounted actuator.

Referring initially to FIG. 1, a skylight assembly with head rail mounted actuator is shown and generally designated 10. It is to be understood that the present invention applies to covering non-vertical openings in general, such as but not limited to recreational vehicle windows, angled boat portholes, etc. Also, the present principles can be applied to spring-drive roll-up shades, as well as accordion-type window coverings.

FIG. 1 shows that the skylight assembly 10 includes a head rail 12 and a foot rail 14. Furthermore, the skylight assembly 10 defines a left side 16 and a right side 18. FIG. 1 shows that the skylight assembly 10 includes a transparent or translucent generally flat, is rectangular panel 20 that is installed between the head rail 12 and the foot rail 14. A collapsible shade 22, e.g., an accordion-type shade, having approximately the same length and height of the panel 20 is slidably disposed along the surface of the panel 20. It is to be appreciated that when the skylight assembly is installed in a business building or dwelling, the shade 22 is juxtaposed with the interior surface of the panel 20. FIG. 1 shows that the shade 22 includes a rail 24 having a first connection point 26 and a second connection point 28.

A spindle assembly 30 is disposed within the head rail 12. The spindle assembly 30 defines a central axis 32 about which the shaft, described below, rotates. FIG. 1 also shows an actuator 34 coupled to the end of the spindle assembly 30. When energized, the actuator 34 causes the spindle assembly 30 to rotate about the axis 32 and, as described below, the rotation of the spindle assembly 30 causes the shade 22 to open and close.

As shown in FIG. 1, the skylight assembly 10 includes a first extender cord 36 that defines a proximal end 38 and a distal end 40, and a second extender cord 42 that likewise defines a proximal end 44 and a distal end 46. Additionally, the skylight assembly 10 includes a first retractor cord 48 that defines a proximal end 50 and a distal end 52, and a second retractor cord 54 that defines a proximal end 56 and a distal end 58. FIG. 1 shows that the proximal ends 38, 44, 50, 56 of the cords 36, 42, 48, 54 are wrapped around the spindle assembly 30, as described in greater detail below. On the other hand, the distal ends 40, 52 of the first extender cord 36 and the first retractor cord 48 are attached to the first connection point 26 on the rail 24, and the distal ends 46, 58 of the second extender cord 42 and the second retractor cord 54 are attached to the second connection point 28 on the rail 24.

Still referring to FIG. 1, the skylight assembly 10 includes a static cord 60 having a first end 62 and a second end 64. As can be appreciated by looking at FIG. 1, the static cord 60 is woven through the shade 22 such that a rectangular loop paralleling the outer edges of the shade 22 is created by the static cord 60. The first end 62 of the static cord 60 is connected directly to the foot rail 14 and the second end 64 of the static cord 60 is connected to a tension spring 66 which, in turn, is connected to the foot rail 14. When pulled taut by the spring 66, the static cord 60 provides a pair of somewhat rigid guides along which the shade 22 slides back and forth as indicated by arrow 68 and arrow 70 and described more fully below.

FIG. 1 also shows a left "L" bracket 72 and a right "L" bracket 74 that are installed over the left and right sides 16, 18 of the skylight assembly 10, respectively, in order to protect the cords 36, 42, 48, 54, 60 installed along the left and right edges of the shade 22. Moreover, to aid in mounting the skylight assembly 10 within an appropriately sized opening, a pair of upper brackets 76 and a pair of lower brackets 78 are also included.

Figure 2:
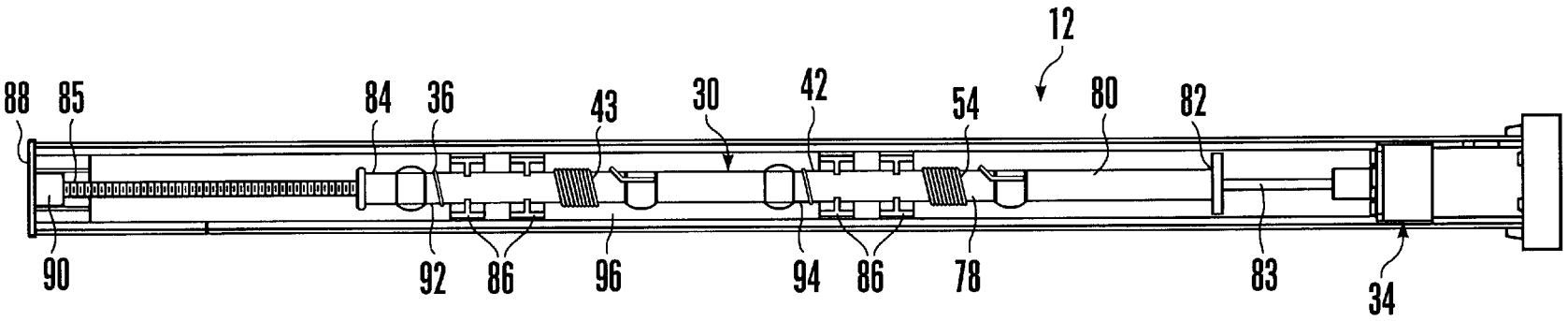
FIG. 2 is a top view of the head rail.

Referring to FIG. 2, details regarding the head rail 12 and the spindle assembly 30 disposed therein can be seen. FIG. 2 shows that the spindle assembly 30 includes a shaft 80 having a first end 82 and a second end 84. A travel screw 85 is threadably engaged with the second end 84 of the shaft 80, such that as the shaft 80 rotates, it travels linearly along the screw 85.

The shaft 80 is supported along its length by plural supports 86 that support the shaft 80 while allowing it to rotated about the axis 32. The first end 82 of the shaft 80 is coupled to the actuator 34. Specifically, in one preferred implementation, a square metal rod 83 connects the shaft 80 to the actuator 34. The rod 83 rotates with and reciprocates within the shaft 80 as the shaft travels along the screw 85. A hollow end cap 88 supports the screw 85 and, hence the second end 84 of the shaft 80. Accordingly, the end cap 88 includes the screw along which the shaft moves linearly. The pitch of screw 85 equals width of cords disclosed herein, so that as the shaft 80 moves along the screw 85, the cords wind and unwind on the shaft 80 without overlapping and otherwise tangling. Further details of the cooperation between the screw 85 and shaft 80 are set forth in U.S. Pat. No. 5,184,660, incorporated herein by reference.

As shown in FIG. 2, the shaft 80 includes a first extender cord winding area 92, and a second extender cord winding area 94 around which the extender cords 36, 42 respectively are wound. Additionally, the shaft 80 includes a first retractor cord winding area 96 and a second retractor cord winding area 98 around which the retractor cords 48, 54 respectively are wound.

Figure 3:
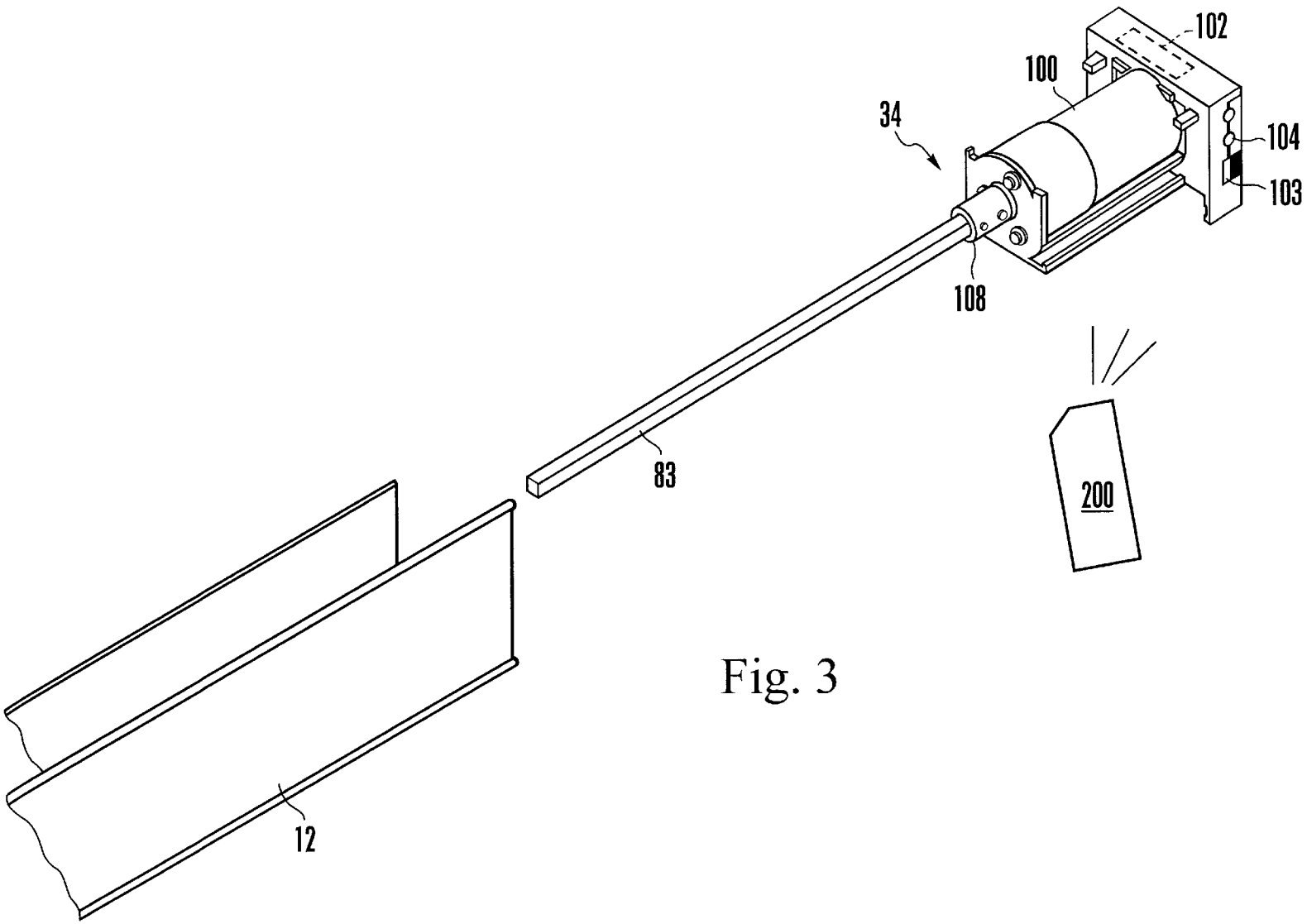
FIG. 3 is a perspective view of the actuator, with a battery shown in phantom.

Referring now to FIG. 3, the actuator 34 includes a preferably dc motor 100 coupled to a preferably dc power source 102, e.g., one or more dc batteries. The batteries are primary batteries supported by the head rail 12. The batteries can be type AA alkaline or lithium batteries, and in any case, are the sole source of power for the motor 100. The batteries can be disposed within or alongside the head rail 12.

FIG. 3 also shows that the actuator 34 includes at least one sensor 103 which receive signals from a hand-held signal generator 200 to activate the actuator 34 to move the shade 22. Manual control buttons 104 can also be provided to manually energize and/or program the motor to open and close the shade.

As shown in FIG. 3, the motor 100 includes a flexible coupling 108 into which the rod 83 is disposed. The actuator 34 fits into the end of the head rail 12 and the rod 83 is slidably coupled to the first end 82 of the spindle assembly shaft 80, as shown in FIGS. 1 and 2. Details of the circuit and operation of the motor 100 is shown in one or more of the following U.S. Patents herein incorporated by reference: U.S. Pat. Nos. 5,444,339; 5,495,153; 5,698,958; 5,729,103; 5,883,480; and 5,907,227. The cord take-up system shown in U.S. Pat. No. 5,725,040, incorporated herein by reference, can be used in cooperation with the present invention.

OPERATION

Referring back to FIG. 1, as the actuator 34 rotates the spindle assembly shaft 80 counter clockwise, causing the shaft 80 to linearly move along the screw 85, the retractor cords 48, 54 wind around the shaft 80 causing the shade 22 to move in the direction indicated by the arrow 70 toward the open configuration. On the other hand, as the actuator 34 rotates the shaft 80 in the clockwise direction, causing it to move back along the screw, the extender cords 36, 42 wind around the shaft 80 causing the shade 22 to move in the direction indicated by arrow 68 toward the closed configuration. It is to be appreciated that as the retractor cords 48, 54 wind around the shaft 80, the extender cords 36, 42 unwind from the shaft 80. Conversely, as the extender cords 36, 42 wind around the shaft 80, the retractor cords unwind from the shaft 80.

It is to be appreciated that when retrofitting existing skylights to include the skylight assembly with head rail mounted actuator 10 of the present invention it is unnecessary to include the transparent panel 20. Accordingly, without the panel 20 the skylight assembly 10 is installed proximal to an existing skylight such that the shade 22 is juxtaposed with the interior surface of the skylight material.

With the configuration of structure described above, it is to be appreciated that the skylight assembly with head rail mounted actuator provides a device that can be used to remotely or automatically open and close skylight shades. Additionally, the present invention is comparatively simple in its operation and installation.

While the particular skylight assembly with head rail mounted actuator as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

I claim:

1. An assembly with actuator, comprising:

a head rail;

a shaft rotatably disposed within the head rail;

a collapsible shade engaged with the shaft and movable between an open configuration, wherein the shade is fully collapsed, and a closed configuration, wherein the shade is extended;

the shade having an end fixed to the head rail and an opposite movable end;

at least one electric motor in the head rail and coupled to the shaft;

at least one dc battery supported by the head rail and electrically connected to the motor;

at least one extender cord attached to the shade and partially wound around the shaft, the extender cord winding around the shaft to move the shade to the closed configuration as the shaft rotates in a first direction;

the extender cord having one end fixed to the shaft and an opposite end fixed to the movable end of the shade;

at least one retractor cord attached to the shade and partially wound around the shaft, the retractor cord winding around the shaft to move the shade to the open configuration as the shaft rotates in a second direction, the retractor cord unwinding from the shaft when the shaft rotates in the first direction; and the retractor cord having one end fixed to the shaft and an opposite end fixed to the movable end of the shade.

2. The assembly of claim 1, further comprising:

at least one static cord looped through the shade to provide at least two semi-rigid guides along which the shade slides between the open configuration and closed configuration.

3. The assembly of claim 2, further comprising:

at least one tensioning device to keep the static cord taut.

4. The assembly of claim 3, wherein the tensioning device is a spring attached to at least one end of the static cord.

5. The assembly of claim 1, wherein the battery is the sole source of power for the motor.

6. The assembly of claim 1, wherein the battery is mounted in the head rail.

7. The assembly of claim 1, further comprising:

a control signal generator for generating a control signal to cause the battery to energize the motor to rotate the shaft and thereby cause the shade to move between the open configuration and closed configuration.

8. The assembly of claim 1, further comprising:

an electronic circuit for processing a control signal and energizing the motor in response thereto.

9. The assembly of claim 1, wherein the collapsible shade is an accordion-type shade.

10. The assembly of claim 1, further comprising:

a control signal generator for generating a control signal.

11. The assembly of claim 1, further comprising:

an electronic circuit having an energized state for processing a control signal to cause the battery to energize the motor to move the rod, the electronic circuit also having an idle state in which the battery is not caused to energize the motor.

12. The assembly of claim 1, wherein the battery is a AA alkaline battery or a AA lithium battery.

* * * * *